US007900930B2

(12) United States Patent
Donegan et al.

(10) Patent No.: US 7,900,930 B2
(45) Date of Patent: Mar. 8, 2011

(54) GAME APPARATUS

(75) Inventors: Noel Donegan, Walkinstown (IE); Luz Java, Walkinstown (IE)

(73) Assignee: Luz Java Limited, Dublin (IE)

( * ) Notice: Subject to any disclaimer, the term of this patent is extended or adjusted under 35 U.S.C. 154(b) by 49 days.

(21) Appl. No.: 11/817,095

(22) PCT Filed: Feb. 27, 2006

(86) PCT No.: PCT/EP2006/060309

§ 371 (c)(1),
(2), (4) Date: Jun. 10, 2008

(87) PCT Pub. No.: WO2006/089967

PCT Pub. Date: Aug. 31, 2006

(65) Prior Publication Data

US 2009/0045580 A1 Feb. 19, 2009

(30) Foreign Application Priority Data

Feb. 25, 2005 (IE) ..... S2005/0102

(51) Int. Cl.
*A63F 9/20* (2006.01)

(52) U.S. Cl. ..... 273/450; 273/449

(58) Field of Classification Search ..... 273/440, 273/447, 449, 450, 290, 160
See application file for complete search history.

(56) References Cited

U.S. PATENT DOCUMENTS

| | | | | | |
|---|---|---|---|---|---|
| 1,978,107 | A * | 10/1934 | Hoffmann | 273/153 R |
| 3,545,747 | A * | 12/1970 | Thomas | 273/449 |
| 3,546,792 | A * | 12/1970 | Sherman | 434/96 |
| 3,680,866 | A * | 8/1972 | Kerr | 273/293 |
| 3,827,695 | A * | 8/1974 | Hess | 273/292 |
| 4,239,231 | A * | 12/1980 | Henderson | 273/293 |
| 6,022,026 | A * | 2/2000 | Johnson, III | 273/450 |
| 6,679,496 | B2 * | 1/2004 | Grebler et al. | 273/290 |
| 6,971,649 | B2 * | 12/2005 | Richardson et al. | 273/299 |
| 7,059,606 | B2 * | 6/2006 | Butcher et al. | 273/450 |
| 2005/0104298 | A1 * | 5/2005 | Butcher et al. | 273/450 |
| 2009/0045580 | A1 * | 2/2009 | Donegan et al. | 273/447 |

FOREIGN PATENT DOCUMENTS

GB 2307867 A * 6/1997

* cited by examiner

*Primary Examiner* — Raleigh W. Chiu
(74) *Attorney, Agent, or Firm* — Holland & Knight LLP; Jeffrey T. Placker, Esq.; Brian J. Colandreo, Esq.

(57) ABSTRACT

The game apparatus has a plurality of elongate coloured building blocks. During the course of a game a number of the blocks are built up block by block in a desired orientation on an associated plinth forming an upright structure until this structure collapses. Each building block is of square section and is subdivided into five coloured engagement portions each of which has a different colour. When building up the structure the coloured building blocks may only interengage where their touching engagement portions are of the same colour.

17 Claims, 6 Drawing Sheets

GAME APPARATUS

RELATED APPLICATION

The subject application is a U.S. National Stage application that claims the priority of International Application No. PCT/EP2006/060309, filed on 27 Feb. 2006, which claims the priority of Irish National Application No.: S2005/0102, filed on 25 Feb. 2005.

This invention relates to a game apparatus.

Stacking brick games are known, for example. U.S. Pat. No. 4,522,393, U.S. Pat. No. 5,611,644 and GB 2 130 105 in which a tower of bricks, is built and then players in turn remove intermediate bricks and place them on top of the lower until the tower eventually collapses. A three-dimensional domino game is disclosed in U.S. Pat. No. 3,827,695. Each domino bears two sots of number indicia which may be the same or different. The dominos can be either stacked upright or laid out side by side on a horizontal surface with corresponding numbers abutting. GB 2 307 867 discloses a similar game apparatus, but using three numbers: per block instead of two.

The present invention is directed towards providing a new game apparatus of the stacking block or brick type.

SUMMARY OF THE INVENTION

According to the invention there is provided a game apparatus, including:

a plurality of associated building blocks, each building block being sub-divided into a plurality of separate engagement portions for cooperation with complementary engagement portions on the other bulking blocks when building a structure from a number of said building blocks, each separate engagement portion of a building block being denoted by a characteristic indicia on said engagement portion, all of the engagement portions on each building block having different characteristic indicia.

In a preferred embodiment, the game apparatus includes a set of building blocks with a different sequence of engagement portions on each building block of said set of building blocks.

In a particularly preferred embodiment the indicia is a colour which covers part or all of the engagement portion. Most preferably the colour covers all exposed surfaces of the engagement portion.

In a further embodiment the indicia is a representation of a character, or person either real or imaginary.

In one embodiment the game apparatus further includes a plinth having engagement means on top of the plinth to receive and support a building block. The building block may be supported in a horizontal or vertical orientation.

In another embodiment the engagement means comprises a socket adapted to receive a building block.

In another embodiment the engagement means comprises a cruciform socket adapted to receive a block on its side in one of two mutually perpendicular orientations.

In another embodiment each building block has an odd number of engagement portions.

In a further embodiment five engagement portions are provided on each building block.

In another embodiment the engagement portions are arranged in-line.

In another embodiment the game apparatus further Includes one or more L-shaped building blocks.

In another embodiment, the game apparatus includes one or more T-shaped blocks.

In another embodiment the game apparatus includes one or more cruciform building blocks.

In a further embodiment the game apparatus includes a selection of building blocks having different numbers of engagement portions.

In another embodiment, the game apparatus includes a bag or pouch for reception and storage of a number of the building blocks and to allow players randomly select building blocks during a game.

In another embodiment the game apparatus includes:

a plurality of associated building blocks, each building block having a parallelepiped shape of square cross-section, each building block being sub-divided into a plurality of separate interconnected engagement portions for cooperation with complementary engagement portions on the other building blocks when building a structure from a number of said building blocks, each separate engagement portion of a building block being denoted by a characteristic colour on said engagement portion, all the engagement portions on each building block having different characteristic colours.

In another embodiment the game apparatus includes:

a plurality of associated building blocks, each building block having a parallelepiped shape of square cross-section, each building block being sub-divided Into a plurality of separate interconnected cubic engagement portions for cooperation with complementary engagement portions on the other building blocks when building a structure from a number of said building blocks, each separate engagement portion of a building block being denoted by indicia representing a character, all of the engagement portions on each building block having a different character thereon.

Such markings, indicia or designs typically will be surface markings. However, they could possibly be made in relief, although in this case it is desirable that each engagement portion allows for relatively stable sealing engagement with another like engagement portion of another building element.

BRIEF DESCRIPTION OF THE DRAWINGS

The invention will be more clearly understood by the following description of some embodiments thereof, given by way of example only, with reference to the accompanying drawings, in which.

DETAILED DESCRIPTION OF PREFERRED EMBODIMENTS

Figure 4:
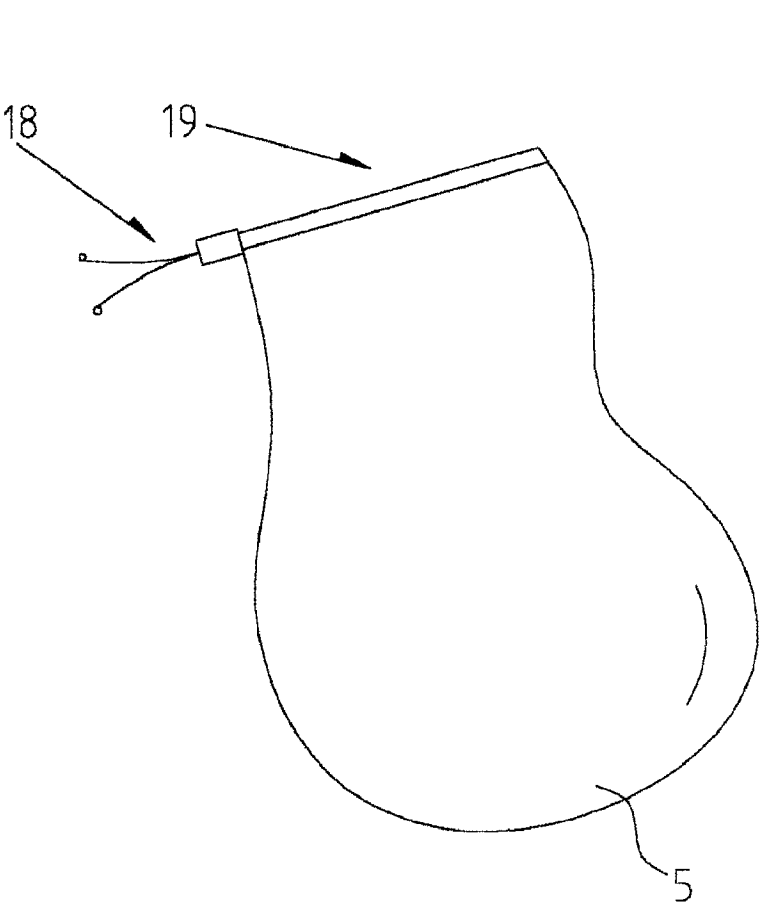
FIG. 4 is a perspective view of a pouch forming portion of the game apparatus.

Referring to the drawings, there is illustrated a game apparatus according to the invention indicated generally by the reference numeral 1. The game apparatus 1 includes a number of associated building elements which in this case are formed by elongate coloured blocks 2. During the course of a game a number of the blocks 2 are interengaged in a preset, regulated fashion to form an upright structure indicated generally by the reference numeral 3 on an associated plinth 4. The game apparatus also includes a pouch 5 for reception and storage of the coloured blocks 2 and to provide for players randomly selecting coloured blocks 2 during a game.

Each building block 2 is of parallelepiped shape of square section and is subdivided into five coloured engagement portions, namely a red portion 6, orange portion 7, yellow portion 8, green portion 9 and blue portion 10. These engagement portions 6, 7, 8, 9, 10 essentially form a number of in-line juxtaposed cubes joined end to end. It will be noted that random sequences of these colours are provided on the various building blocks 2 of the game apparatus. Typically in the order of sixty blocks might be provided in the game apparatus. It will be noted that five different coloured engagement portions are provided on each block 2. Also, a different sequence of colours is provided on each block 2.

Each block 2 is divided into five equal sections and each of those sections is denoted by a different colour. Each block 2 contains the same five colours, however no two blocks are identical with regard to the positioning of their coloured sections.

Figure 1:
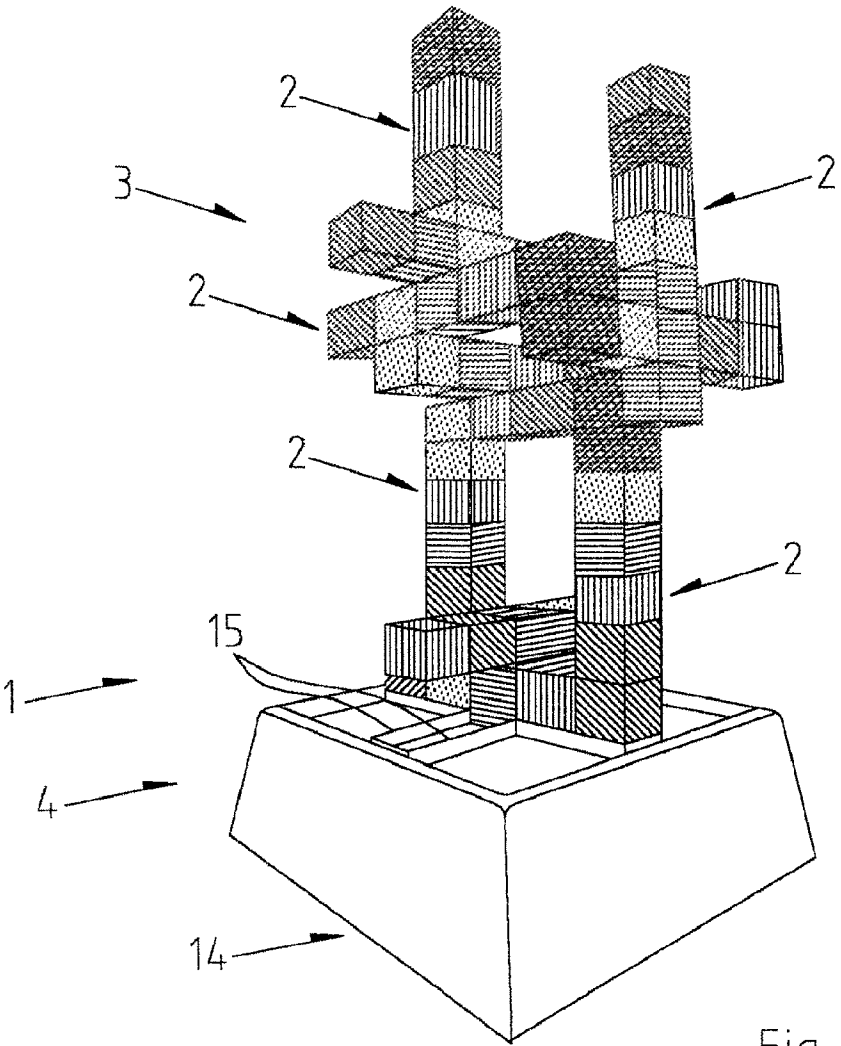
FIG. 1 is a perspective view of a game apparatus according to the invention, shown in-use.

The plinth 4 has a ground engaging base 14 for seating on a table for example during the playing of a game. Formations 15 are provided at a top of the plinth 4 for reception and engagement with a building block 2. In the embodiment shown, two recesses or sockets in a cruciform construction are provided at a top of the plinth 4 for reception of a coloured building block 2 on its side as shown in FIG. 1.

The pouch 5 receives and stores the coloured building blocks 2, and indeed may be made large enough to also store the plinth 4 when not in use. A drawstring 18 is provided at a mouth 19 of the pouch 5 for closure of the pouch 5.

In use, the plinth 4 is mounted on a table or the like. Where a number of players are involved they decide the order of play, by tossing a coin for example. The first player reaches into the pouch 5 (without looking) and takes a coloured building block 2 from the pouch 5. The player then mounts the coloured building block 2 on the plinth 4 either on its side as shown in FIG. 1 or in an upright orientation in engagement with the complementary formations 15 formed on top of the plinth 4. Each succeeding player reaches into the pouch 5 and selects a coloured building block 2 which the player then places on the building block 2 or blocks 2 already laid in the structure 3 on the plinth 4. Thus a structure 3 comprising a number of stacked coloured building blocks 2 is gradually built up on the plinth 4. Each player must however only build colour on colour. This means that they may only place their coloured building block 2 on another building block or blocks 2 as long as the coloured engagement portion 6, 7, 8, 9, 10 of the block 2 being placed is of the same colour as the coloured engagement portion 6, 7, 8, 9, 10 of the coloured building block 2 being built upon. In other words, the coloured building blocks 2 may only interengage where the touching engagement portions 6, 7, 8, 9, 10 of the blocks 2 are of the same colour.

Figures 2, 3:
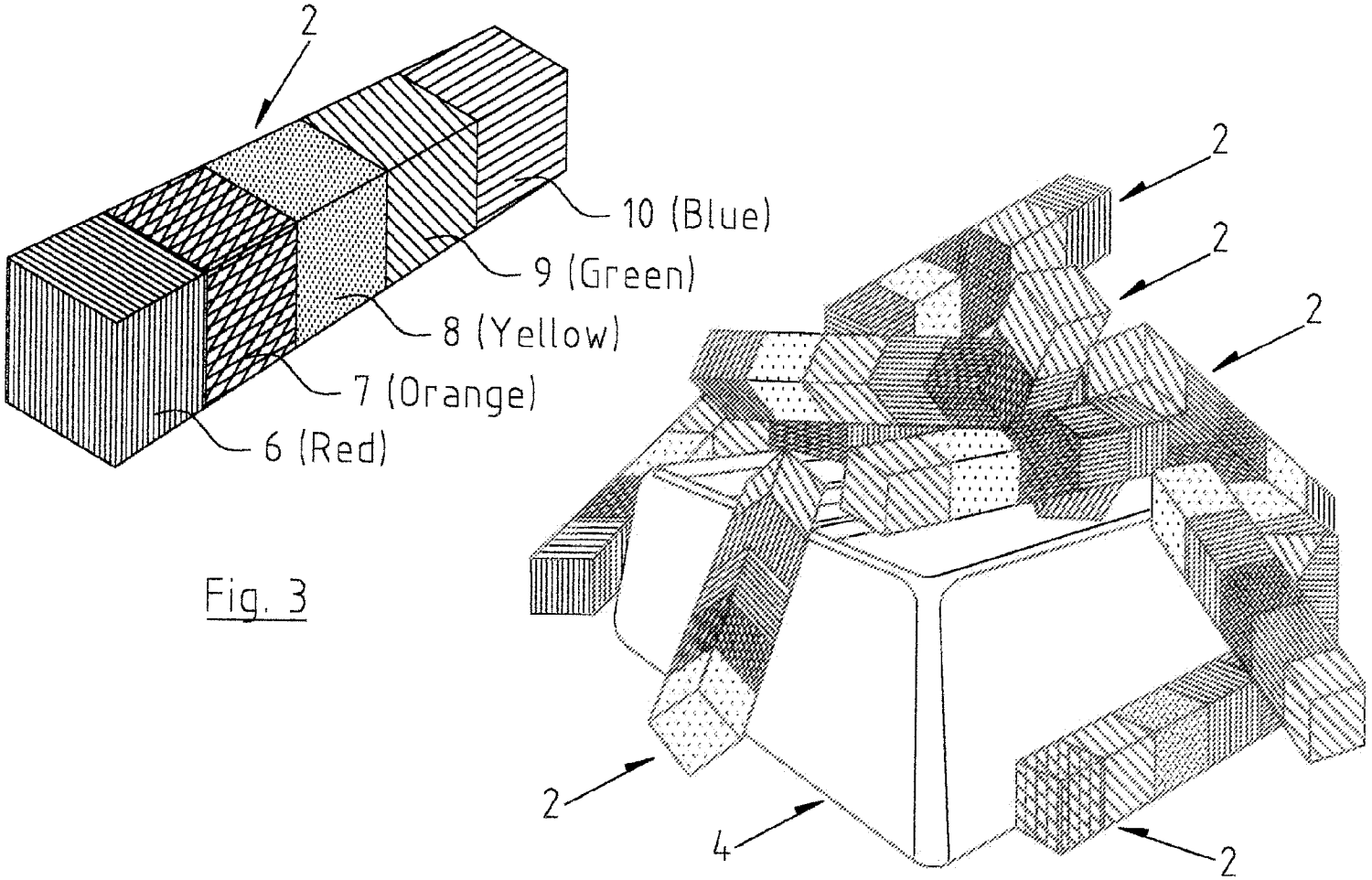
FIG. 2 is a perspective view of the game apparatus, shown in another position of use.
FIG. 3 is a perspective view of a building element forming portion of the game apparatus according to the invention.

When a player places a block 2 on the structure 3 which causes the structure 3 to topple, as shown in FIG. 2 then this player is eliminated from the game. The blocks 2 are replaced in the pouch 5 and the game restarts with the remaining players. The last player left is the winner.

A single player may also play a game using the game apparatus 1 to see how many blocks 2 they can build into the structure 3 before the structure 3 topples.

Figure 5:
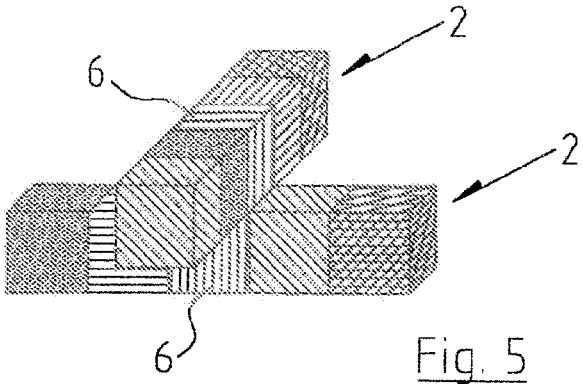
FIG. 5 is a perspective view showing a pair of building blocks of the game apparatus, interengaged in use.
Figure 6:
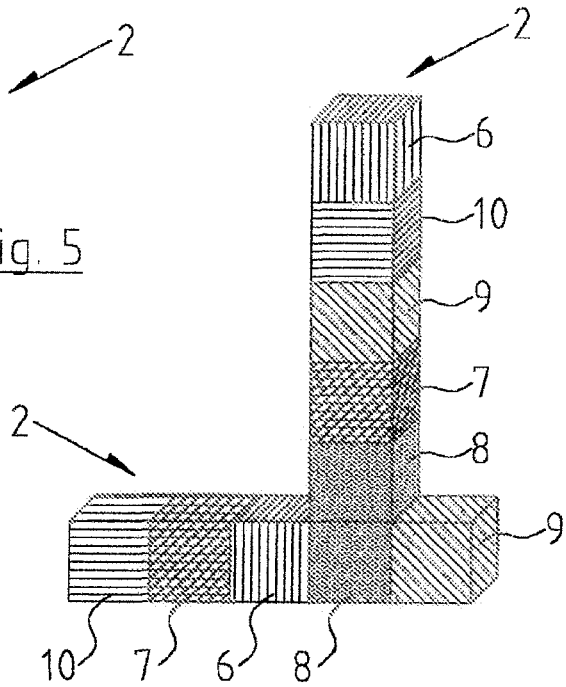
FIG. 6 is a perspective view showing a pair of building blocks of the game apparatus, shown interengaged in another configuration.
Figure 7:
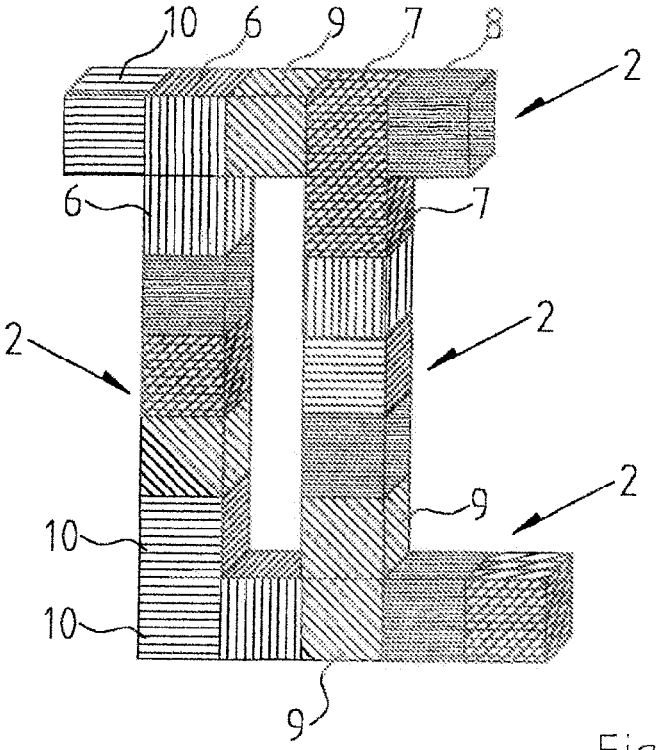
FIG. 7 is a perspective view showing four building blocks of the game apparatus, shown interengaged in a required orientation during the course of the game.

It will be noted that each new block 2 placed on the structure 3 may simply be balanced with a central coloured engagement portion 6 seating on a complementary coloured engagement portion 6 on a previously placed block 2 immediately below it as shown in FIG. 5. FIG. 6 shows a block 2 stood upright on a lower block 2. Alternatively a block 2 may be spanned between two or more previously laid blocks 2 (as shown in FIG. 7) providing that the engagement portions 6, 7, 8, 9, 10 where all of the blocks 2 engage are of the same colour.

Figure 8:
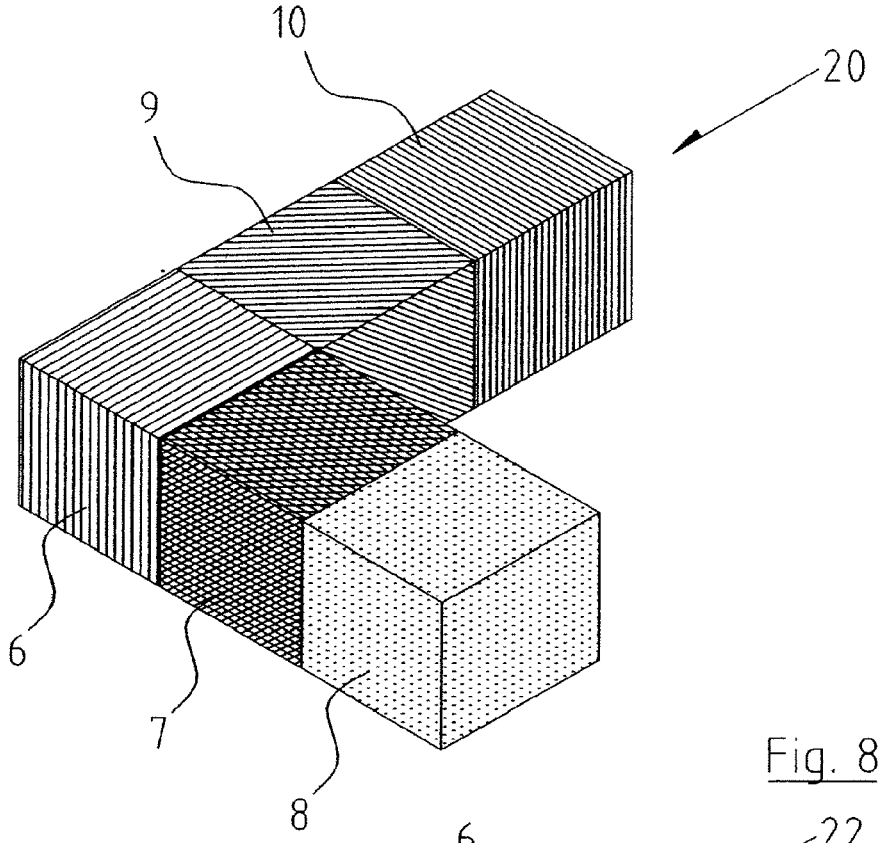
FIG. 8 is a perspective view of another building block of the game apparatus.

FIG. 8 shows an L-shaped building block 20, again including five coloured engagement portions 6, 7, 8, 9, 10. A number of these may be included in the game apparatus.

Figure 9:
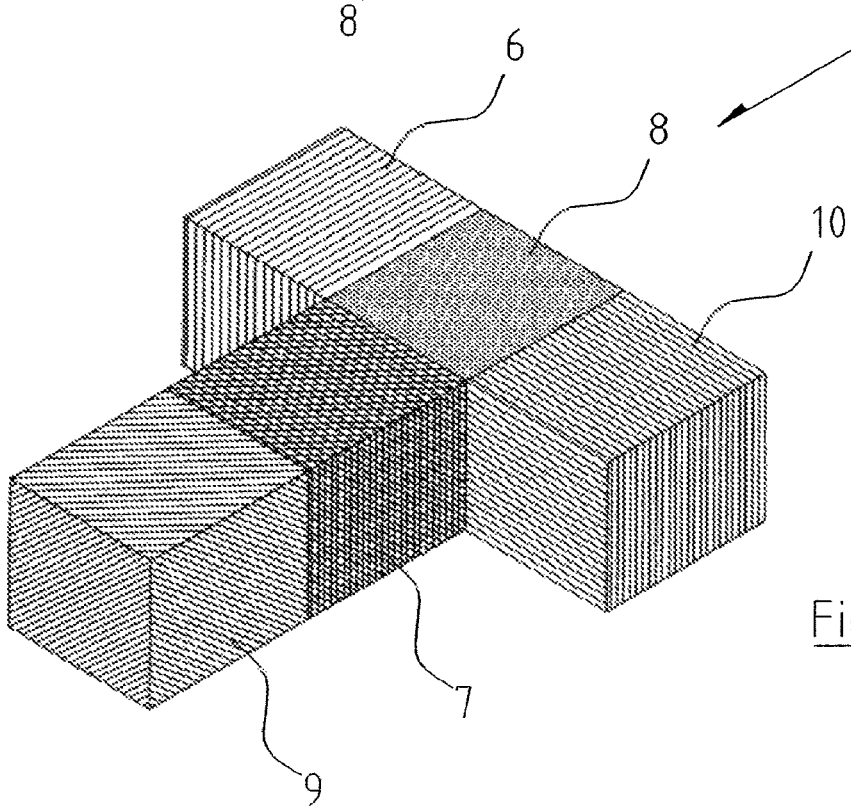
FIG. 9 is a perspective view of a further building block.

FIG. 9 shows a T-shaped building block 22 with coloured engagement portions 6, 7, 8, 9, 10. A number of these may be includes in the game apparatus if desired.

Figure 10:
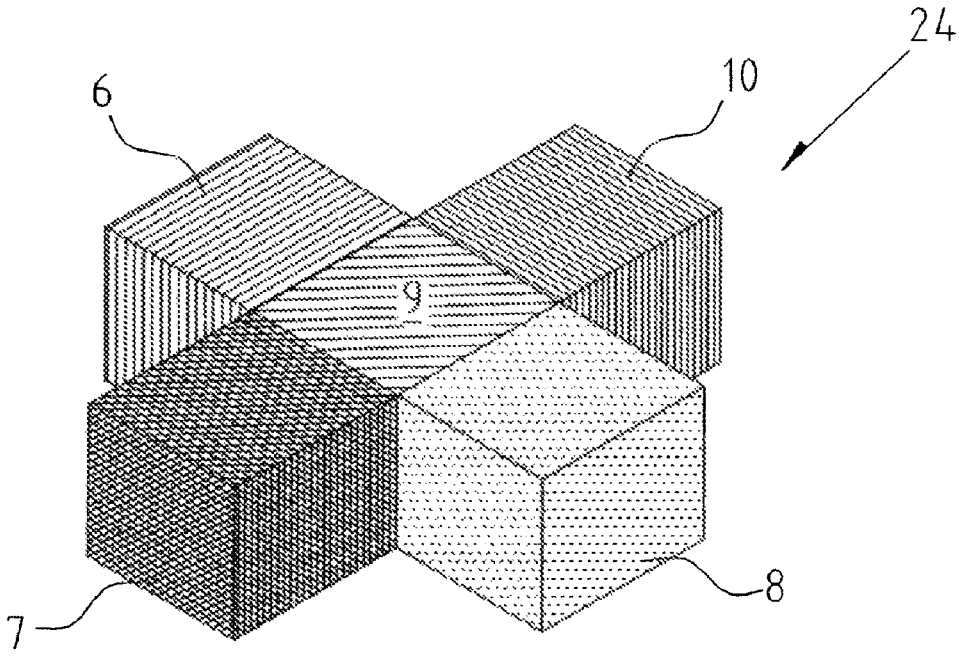
FIGS. 10-15 show various alternative constructions of building blocks.

FIG. 10 shows a cruciform building block 24 with the coloured engagement, portions 6, 7, 8, 9, 10 arranged in a cruciform array.

Figure 11:
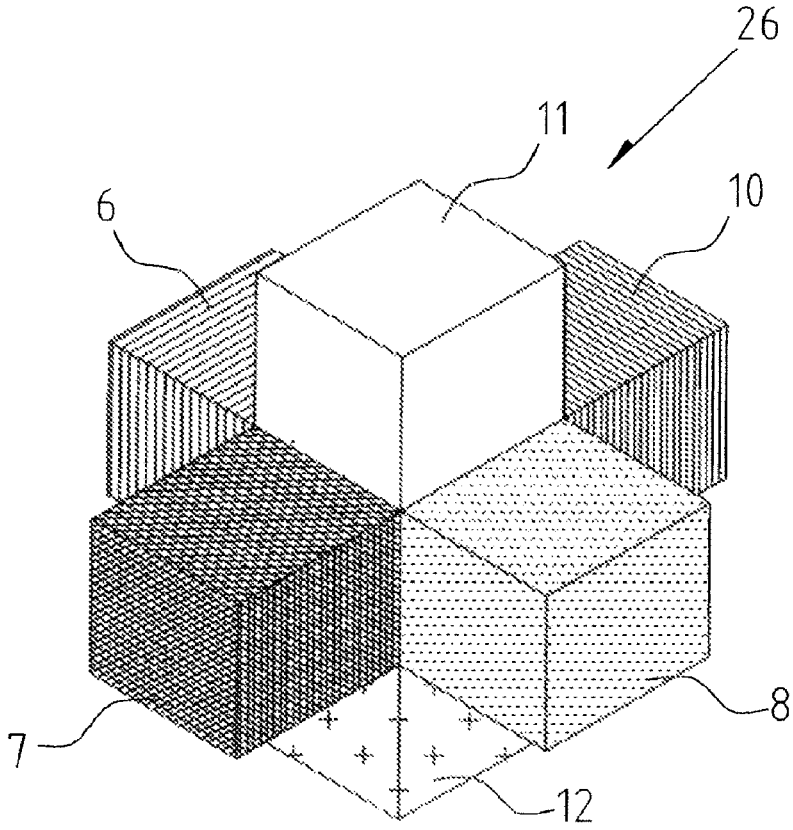

FIG. 11 shows another building block 26 having a "three dimensional" cruciform shape with additional engagement portions 11, 12.

Figure 12:
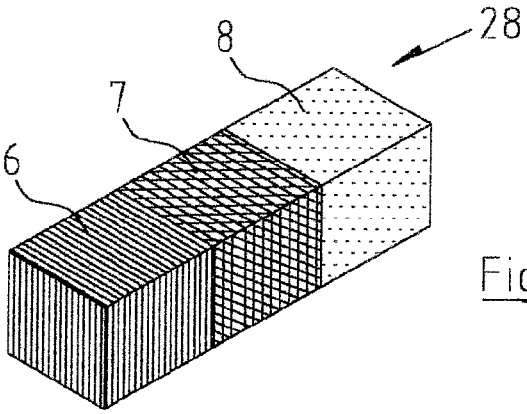

FIG. 12 shows another building block 28 with three engagement portions 6, 7, 8.

Figure 13:
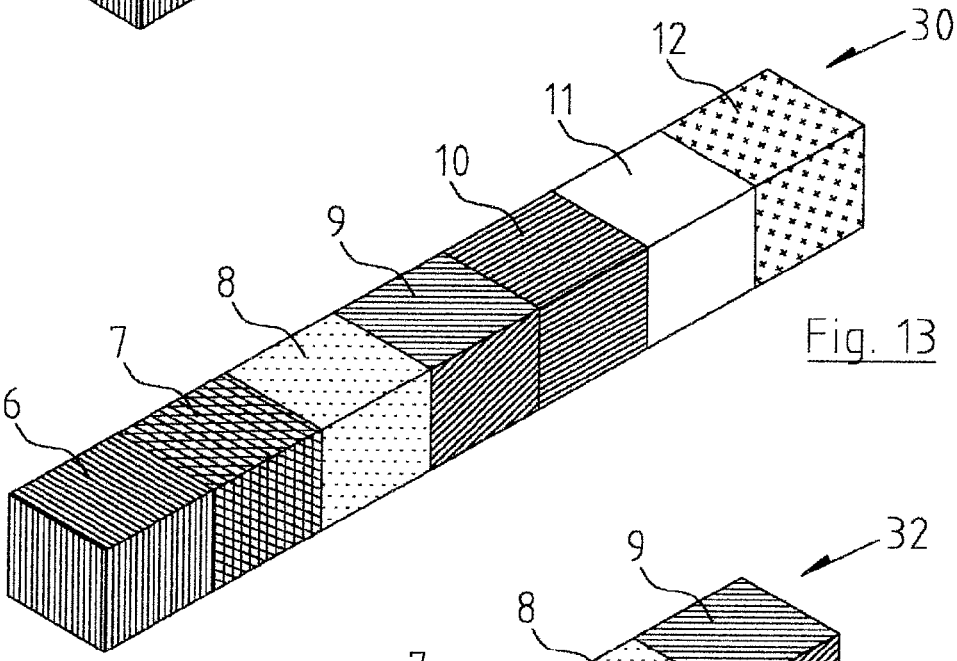

FIG. 13 shows a further building block 30 with seven engagement portions 6, 7, 8, 9, 10, 11, 12.

It will be noted that a game apparatus with building blocks of different size may be provided, for example with three, five and seven engagement portions. Separate pouches may be provided for the building blocks of different sizes. In this case a random selector such as dice may be provided so that at the start of each turn each player will randomly select which pouch to take a building block from for mounting on the structure.

Figure 14:
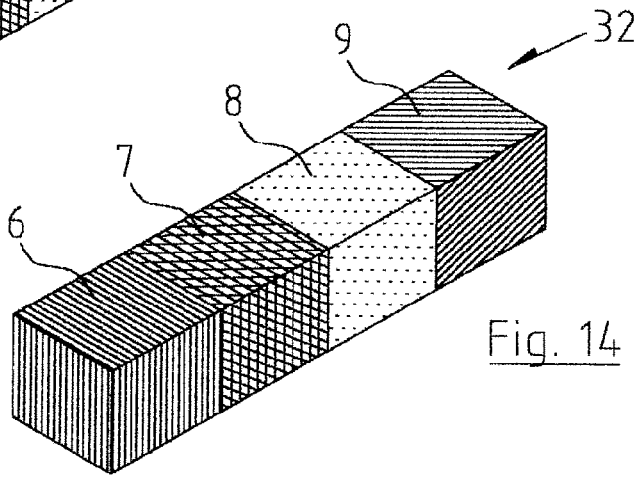

While it is generally preferred that each building block is provided with an odd number of engagement portions as this means they can be balanced about the central engagement portion (as shown in FIG. 5) when building on the structure, in some cases building blocks with an even number of engagement portions may be provided. Such a building block 32 is shown in FIG. 14.

Figure 15:
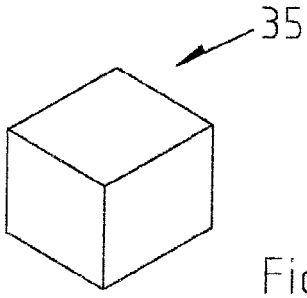

FIG. 15 shows another building block 35 of cubic shape which may be provided in any colour. A number of these single blocks may be provided in the game apparatus if desired.

It will be appreciated that the invention provides a game apparatus which is both fun to play and also teaches spatial awareness and hand/eye coordination.

It is also envisaged that if desired a number of building blocks having a single engagement portion, that is of cubic construction, may also be provided in the game apparatus in addition to the multiple engagement portion building blocks previously described. FIG. 15 shows such a cubic building block 35.

It will be noted that instead of the colours denoting the engagement portions 6, 7, 8, 9, 10 a picture of a face or character either real or imaginary may be provided on the blocks 2 for subdividing the blocks 2 into the various engagement portions. Other indicia is also possible which clearly shows each separate engagement portion on the building block.

While a plinth 4 is shown as portion of the game apparatus 1 described above, in some cases this may be omitted and the structure 3 of building blocks 2 built up on any flat, horizontal surface such as a table top.

The invention is not limited to the embodiments hereinbefore described which may be varied in both construction and detail within the scope of the appended claims.

The invention claimed is:

1. A game apparatus, including:

a plurality of associated building blocks, each building block being sub-divided into at least three separate engagement portions for cooperation with complementary engagement portions on the other building blocks when building a structure from a number of said building blocks, each separate engagement portion of a building block being denoted by a characteristic indicia on said engagement portion, all of the engagement portions on each building block having different characteristic indicia.

2. The game apparatus as claimed in claim 1 including a set of building blocks with a different sequence of engagement portions on each building block of said set of building blocks.

3. The game apparatus as claimed in claim 1 wherein the indicia is a colour.

4. The game apparatus as claimed in claim 1 wherein the indicia is a representation of a character.

5. The game apparatus as claimed in claim 1 wherein the game apparatus further includes a plinth having engagement means on top of the plinth to receive and support a building block.

6. The game apparatus as claimed in claim 5, wherein the engagement means comprises a socket adapted to receive a building block.

7. The game apparatus as claimed in claim 5 wherein the engagement means comprises a cruciform socket adapted to receive a block on its side in one of two mutually perpendicular orientations.

8. The game apparatus as claimed in claim 1 wherein each building block has an odd number of engagement portions.

9. The game apparatus as claimed in claim 1 wherein five engagement portions are provided on each building block.

10. The game apparatus as claimed in claim 1 wherein the engagement portions are arranged in-line.

11. The game apparatus as claimed in claim 1 wherein the game apparatus includes one or more L-shaped building blocks.

12. The game apparatus as claimed in claim 1 wherein the game apparatus includes one or more T-shaped blocks.

13. The game apparatus as claimed in claim 1 which includes one or more cruciform building blocks.

14. The game apparatus as claimed in claim 1 which includes a selection of building blocks having different numbers of engagement portions.

15. The game apparatus as claimed in claim 1 which further includes a bag or pouch for reception and storage of a number of the building blocks and to allow players randomly select building blocks during a game.

16. The game apparatus as claimed in claim 1, including:

a plurality of associated building blocks, each building block having a parallelepiped shape of square cross-section, each building block being sub-divided into a plurality of separate interconnected cubic engagement portions for cooperation with complementary engagement portions on the other building blocks when building a structure from a number of said building blocks, each separate engagement portion of a building block being denoted by characteristic colour on said engagement portion, all of the engagement portions on each building block having a different characteristic colours.

17. The game apparatus as claimed in claim 1, including:

a plurality of associated building blocks, each building block having a parallelepiped shape of square cross-section, each building block being sub-divided into a plurality of separate interconnected cubic engagement portions for cooperation with complementary engagement portions on other building blocks when building a structure from a number of said building blocks, each separate engagement portion of a building block being denoted by indicia representing a character, all of the engagement portions on each building block having a different character thereon.

* * * * *